US005997695A

United States Patent [19]

Ilmarinen

[11] Patent Number: 5,997,695

[45] Date of Patent: Dec. 7, 1999

[54] EXTENDED NIP PRESS

[75] Inventor: Antti Ilmarinen, Jyväskylä, Finland

[73] Assignee: Valmet Corporation, Helsinki, Finland

[21] Appl. No.: 08/994,398

[22] Filed: Dec. 19, 1997

[30] Foreign Application Priority Data

Oct. 14, 1997 [SE] Sweden ..... 9703766-7

[51] Int. Cl.[6] ..... D21F 3/00

[52] U.S. Cl. ..... 162/358.3; 162/358.4

[58] Field of Search ..... 162/358.3, 358.4, 162/358.5

[56] References Cited

U.S. PATENT DOCUMENTS

| | | | |
|---|---|---|---|
| 4,427,492 | 1/1984 | Cronin . | |
| 4,484,982 | 11/1984 | Majaniemi . | |
| 4,492,611 | 1/1985 | Meinander . | |
| 4,570,314 | 2/1986 | Holik et al. | 29/113 R |
| 4,643,802 | 2/1987 | Schiel . | |
| 4,661,206 | 4/1987 | Heitmann et al. . | |
| 4,705,602 | 11/1987 | Dahl . | |
| 5,167,768 | 12/1992 | Cronin et al. . | |
| 5,262,011 | 11/1993 | Ilmarinen . | |
| 5,423,949 | 6/1995 | Ilmarinen . | |
| 5,441,604 | 8/1995 | Sandberg et al. | 162/205 |
| 5,645,691 | 7/1997 | Zuefle et al. | 162/358.3 |
| 5,655,442 | 8/1997 | Conrad et al. . | |
| 5,676,799 | 10/1997 | Meschenmoer | 162/358.3 |

FOREIGN PATENT DOCUMENTS

| | | |
|---|---|---|
| 3503819 C2 | 11/1989 | Germany . |
| 19544979 A1 | 5/1997 | Germany . |

*Primary Examiner*—Peter Chin
*Assistant Examiner*—Kevin Cronin
*Attorney, Agent, or Firm*—Alston & Bird LLP

[57] ABSTRACT

An extended nip press is provided having an advantageous nip press shoe which generates less heat than conventional press shoes. The nip press shoe includes an inrunning land surface which may be planar or convex. At least one lubrication pocket is downstream of the inrunning land surface and defines a cavity for supporting lubricant to create a hydrostatic lubrication region with a flexible jacket. The pocket has a bottom surface which converges towards the flexible jacket in a downstream direction. The press shoe further includes an outrunning land surface downstream of the lubrication pocket for engaging the flexible jacket against the opposite convex press element at a downstream end of the extended nip press. The outrunning land surface has a radius of curvature greater than the radius of curvature of the convex press element, and is planar in one embodiment, to create an attenuated hydrodynamic lubrication region with the flexible jacket.

31 Claims, 4 Drawing Sheets

EXTENDED NIP PRESS

FIELD OF THE INVENTION

The present invention relates to papermaking machines, and more particularly relates to extended nip presses for removing water from a fibrous web as the web passes through a papermaking machine.

BACKGROUND OF THE INVENTION

In the art of papermaking, the use of extended nip presses—also referred to as long nip presses or wide nip presses—in the press section of a papermaking machine has become very popular since the extended nip press has a dewatering capacity that is significantly larger than the dewatering capacity of a conventional roll nip press. The extended nip presses marketed today by various manufacturers are typically of the kind referred to as shoe presses A typical shoe press unit comprises a generally concave shoe, a rotatable flexible tubular jacket running in a loop around the shoe, a stationary support beam for supporting the shoe, at least one (normally several) actuator(s) on the support beam for pressing the shoe against an interior surface of the jacket and a cylindrical counter roll. The shoe is often lubricated to avoid wear with the inner surface of the tubular jacket. The concave shoe and the cylindrical counter roll define between them an extended nip through which a fibrous web is passed.

In comparison with a conventional roll press, an important advantage of a shoe press is that a higher linear loading may be used than in a roll press. The amount of dewatering which takes place in a press nip depends to a large degree on the press impulse that can be calculated as I=L/S where I=the press impulse, L=the linear loading (force per unit length in the cross machine direction) of the press and S=the speed of the paper web through the nip. In theory, the press impulse does not depend on the length of the nip in the machine direction. However, the maximum linear loading that can be applied in the press nip is limited by the pressure to which the web can be subjected.

In a conventional roll press, the nip area is very small and even a relatively low linear loading may result in a pressure which is simply too high for the fibrous web that is passed through the nip. A shoe press with its long nip and large nip area can use a much higher linear loading and yet not reach such high levels of pressure in the nip that crushing of the fibrous web will occur. This is of particular importance for the papermaker who desires to obtain a high bulk product. Since the shoe press can use a high linear loading without subjecting the fibrous web to a high pressure, a high bulk product can be obtained. Therefore, the first commercial use of shoe presses was in machines for making high bulk products, such as board machines. Recently, shoe presses have also been employed for different paper grades.

However, a high dewatering capacity is not always the only desired property of a press unit. For example, it might also be desirable that the final product has a high strength in terms of Scott Bond. In order to obtain a paper with high strength in terms of Scott Bond, the fibrous web should be subjected to a high pressure as it is passed through the press unit. An easy way to obtain a high pressure in the nip is to use a conventional roll press unit. However, a roll nip is not compatible with the requirement for a high dewatering capacity as explained above. In addition, high pressure in the nip may result in a product having insufficient bulk.

An alternative solution would be to use a shoe press and apply a higher linear loading than usual. However, a shoe press is designed to result in a relatively low pressure and even with a high linear loading it can be difficult to obtain a very high level of pressure. Furthermore, if the pressure level in a shoe press nip is raised, frictional heat generated between the flexible jacket and press shoe may become a very serious problem, even if the shoe is lubricated. The frictional heat that is generated may cause deformation of the shoe and other problems associated with dissipating the generated heat, such as overheating of the flexible jacket. The frictional heating can become especially serious if the papermaking machine is run at high speeds such as 25 m/s or higher.

In order to solve the problem of frictional heat generated in a shoe press nip, it has been suggested in U.S. Pat. No. 4,643,802 (Schiel) to use a heat insulating layer between an upper and a lower part of the shoe. However, such a solution makes the shoe more complicated and expensive to manufacture. Furthermore, the use of a heat insulating layer only prevents heat from being conducted to other parts of the machinery, and does not decrease the amount of heat transferred to the tubular jacket.

The amount of frictional heat developed in an extended nip depends on a number of parameters such as nip pressure, machine speed and the lubrication system. For lubrication, a shoe press can be hydrodynamically lubricated or hydrostatically lubricated. In a hydrodynamically lubricated shoe, lubrication oil can be sprayed into an interface between the flexible jacket of the shoe press and a leading edge of the shoe itself as disclosed in e.g., U.S. Pat. No. 5,167,768 (Cronin et. al). In a hydrostatically lubricated shoe, lubrication oil is fed through a conduit in the shoe to a lubrication pocket on the face of the shoe. Such a lubrication system is disclosed in for example U.S. Pat. No. 5,262,011 (Ilmarinen). A hydrostatically lubricated shoe normally also has one or more regions or zones of hydrodynamic lubrication at least adjacent to the leading and/or trailing edges of the hydrostatic lubrication region. The Ilmarinen patent discloses leading and trailing land surfaces which are both concave and have a radius of curvature corresponding to that of the counter roll, thus creating a shoe that is both hydrodynamically and hydrostatically lubricated.

Frictional heat in a shoe press nip is generated in large part by the hydrodynamically lubricated zones. Therefore, the problem of frictional heat could theoretically be overcome by using a shoe that is completely hydrostatically lubricated. It has been suggested, see for example German Patent DE 35 03 819 to Sulzer Escher-Wyss GmbH, that hydrodynamic lubrication be entirely eliminated. The German '819 patent discloses a kind of press shoe which consists almost entirely of a hydrostatic pocket. In theory, such a shoe would generate only a very small amount of frictional heat and could be suitable for high nip pressures in combination with high machine speeds. However, the shoe disclosed in the German '819 patent has a sharp transition from the hydrostatic pocket to the end walls of the pocket. In the transition area, the flexible jacket will be subjected to stress and wear and possibly a considerable degree of heat generation.

The inventor has found that fibrous webs made from wood-containing stock are less pressure sensitive and can be subjected to a high pressure without significant loss of bulk. For such paper grades, for example supercalendered (SC) or light weight coated (LWC), it would be advantageous if the web could be pressed in a press unit with both a high degree of dewatering and a high nip pressure. The inventor has also recognized that this would be best achieved if the web could be passed through a shoe press unit which employs a pressure which is higher than a conventional shoe press (but still lower than a roll press). However, if a conventional shoe press unit employs high pressures of the magnitude required for desired dewatering and Scott Bond strength, excess frictional heat generated in the press nip will become a problem.

Therefore, there is a need for a shoe press that can employ a high nip pressure at high speeds for obtaining a desired level of dewatering and Scott Bond strength. However, such a shoe press should not be subject to overheating of the shoe or jacket and should not suffer from accelerated wear characteristics.

SUMMARY OF THE INVENTION

These and other objects and advantages are met by the nip press shoe according to the present invention which includes an inrunning land surface, a lubrication pocket downstream of the inrunning land surface and an outrunning land surface downstream of the lubrication pocket which advantageously has a radius of curvature greater than the radius of curvature of an opposite convex press element such as a counter roll. In particular, the outrunning land surface is advantageously planar so as to create an attenuated hydrodynamic lubrication region with the flexible jacket which is much smaller than prior press shoe designs having a concave outrunning land surface with a radius of curvature substantially corresponding to the radius of curvature of the convex press element. Because of the attenuated hydrodynamic region, the amount of frictional heat generated is greatly reduced and the machine can be operated at higher speeds and with higher shoe pressures, thus improving productivity.

An extended nip press is also provided by the present invention for dewatering a fibrous web as the fibrous web passes through the press in a machine direction. A flexible jacket having at least one surface impervious to water is provided for pressing the fibrous web against the opposite convex press element, thereby dewatering the fibrous web. The flexible jacket is tubular and encircles a support beam extending in a cross machine direction so as to be on the opposite side of the jacket from the convex press element. At least one actuator is supported by the support beam for creating a pressing force in the general direction of the convex press element.

The press shoe according to the invention is mounted on the actuator for pressing the flexible jacket and the fibrous web against the convex press element to dewater the web. As noted above, the shoe has a face which includes an inrunning land surface for engaging the flexible jacket against the convex press element at an upstream end of the extended nip press.

The inrunning land surface according to one embodiment is planar so as to create an attenuated hydrodynamic lubrication region upstream of the hydrostatic lubrication pocket. According to another embodiment, the inrunning land surface is concave which creates a slightly longer inrunning hydrodynamic region. The inventor has found that a large portion of the frictional heat is generated at the downstream hydrodynamic region, and thus a slightly longer upstream hydrodynamic region does not diminish the desirability of the present invention.

At least one lubrication pocket is provided downstream of the inrunning land surface, and a plurality of separate pockets may be arranged side-by-side in the cross machine direction. The lubrication pockets each define a cavity for supporting lubricant to create a hydrostatic lubrication region with the flexible jacket. Each pocket has a bottom surface converging towards the flexible jacket in a downstream direction. According to one embodiment, the bottom surface of the pocket is planar.

The outrunning land surface downstream of the lubrication pocket engages the flexible jacket against the convex press element at the downstream end of the extended nip press. As noted above, the outrunning land surface advantageously has a positive radius of curvature greater than the radius of curvature of the convex press element which creates an attenuated hydrodynamic lubrication region with the flexible jacket. According to one embodiment, the outrunning land surface is planar and may be coplanar with the bottom surface of the lubrication pocket. According to another embodiment, the outrunning land surface is concave but has a radius of curvature greater than the convex press element. The outrunning land surface may also be convex. Such a shoe will have a very short zone of hydrodynamic lubrication downstream of the hydrostatic pocket and consequently, very little frictional heat will be generated downstream of the hydrostatic pocket.

BRIEF DESCRIPTION OF THE DRAWINGS

Some of the objects and advantages having been stated, others will appear as the description proceeds when taken in conjunction with the accompanying drawings, which are not necessarily drawn to scale, and wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
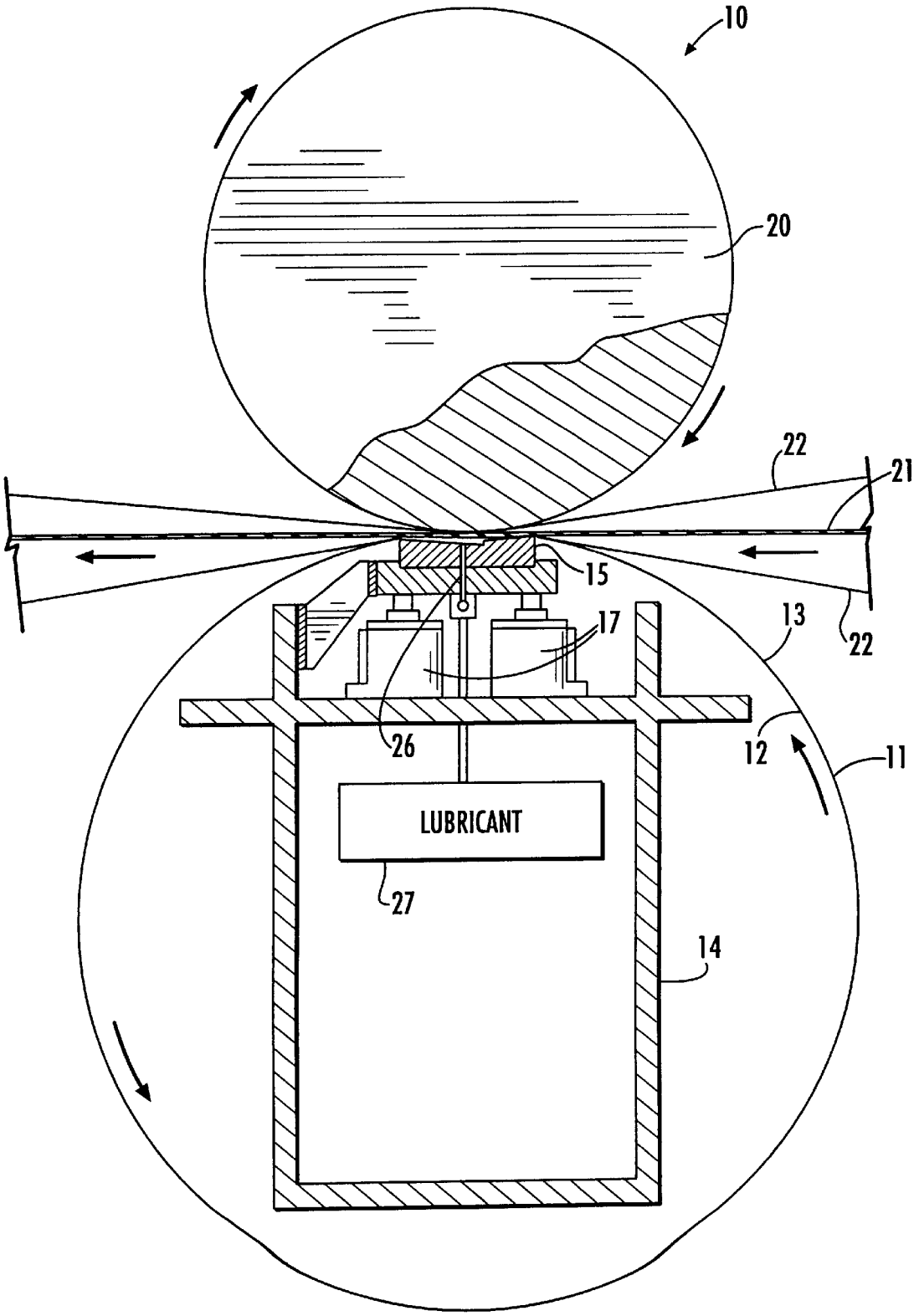
FIG. 1 is a sectional view of an extended nip press unit.

With reference to FIG. 1, an extended nip press 10 is shown. The extended nip press 10 shown in FIG. 1 includes a tubular flexible jacket 11 which is rotatable and impervious to water. The jacket 11 has an interior surface 12 and an exterior surface 13 and it should be understood that the jacket 11 extends in a cross machine direction.

The extended nip press 10 further includes a stationary non-rotatable support beam 14 that extends axially through the jacket 11. Inside the jacket 11, there is a press shoe 15 supported by the support beam 14. The shoe 15 has an exterior face 16 which engages the tubular flexible jacket 11. The shoe 15 extends in a cross machine direction and has a length in the machine direction.

On the support beam 14, there is at least one actuator 17 for advancing the press shoe 15 such that the exterior face 16 of the shoe 15 is pressed against the interior surface 12 of the jacket 11. It should be understood that normally not just one actuator 17 is used and typically a row of actuators would extend along the support beam 14 in the cross machine direction. Possibly, two rows of actuators 17 can be used as indicated in FIG. 1. The actuators 17 and the support beam 14 are shown in FIG. 1 in a form corresponding to that disclosed in U.S. Pat. No. 5,262,011 (Ilmarinen). However, it should be understood that the actuators and the support beam can take many other equivalent shapes and configurations as is well known to those skilled in the art.

The extended nip press 10 further includes a press element 20 opposing the shoe 15. The press element 20 is convex and provides a substantially rigid and incompressible surface against which the fibrous web is pressed. The shoe 15 and the press element 20 form between them an extended nip through which a fibrous web 21 is passed. When the fibrous web 21 is passed through the nip, the web is dewatered by the pressure which is exerted on the web in the nip. A pair of water receiving felts 22 are also passed through the nip adjacent the web 21 in a manner well known for absorbing water pressed from the web.

Figure 6:
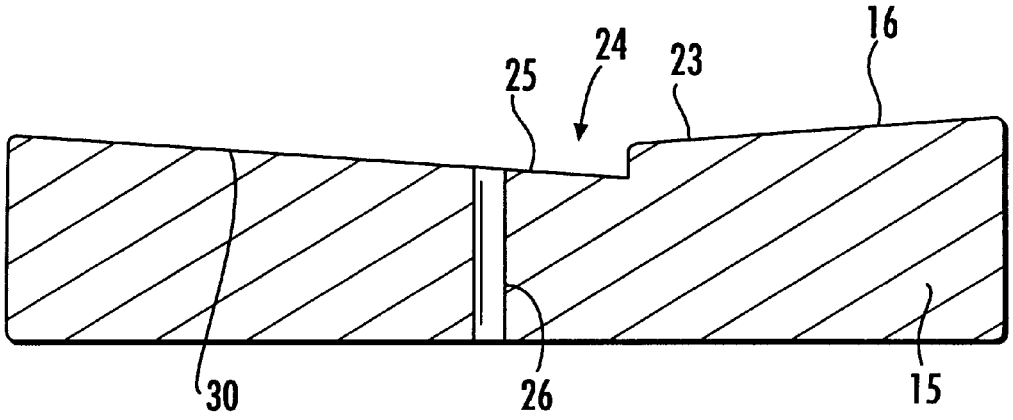
FIG. 6 is an enlarged sectional view of the first nip press shoe embodiment illustrated without other components of the press adjacent thereto.
Figure 7:
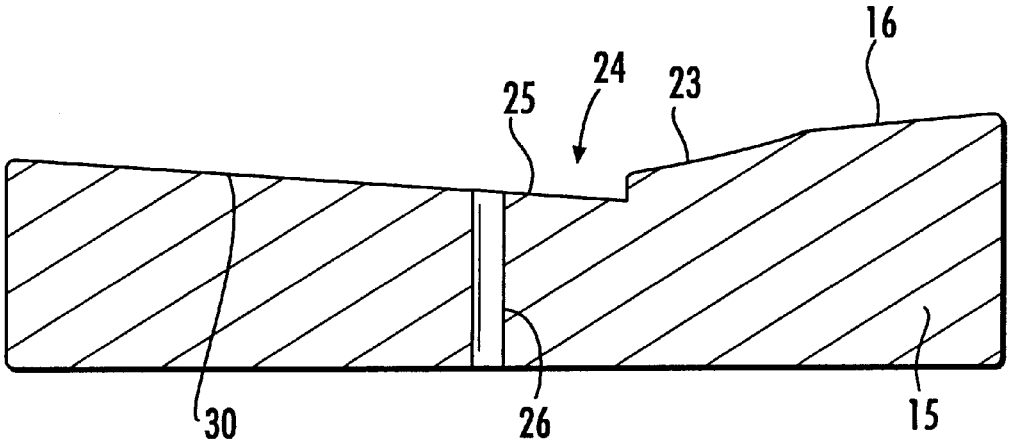
FIG. 7 is an enlarged sectional view of the second nip press shoe embodiment illustrated without other components of the press adjacent thereto.

Several of the advantages of the present invention lie in the shape of the exterior face 16 of the press shoe 15. As can be best seen in FIGS. 6 and 7, the face 16 of the press shoe 15 includes an inrunning land surface 23 which engages the flexible jacket 11 against the opposite convex press element 20 at the upstream end of the extended nip press 10. In the embodiment of FIG. 6, the inrunning land surface 23 is planar whereas in the embodiment of FIG. 7, the inrunning land surface is generally concave and has a radius of curvature which corresponds to the radius of curvature of the convex press element 20. The concave inrunning land surface creates a longer hydrodynamic lubrication region, but excessive heat generation is not a problem because most of the heat is generated at the downstream lubrication region discussed below.

Figure 2:
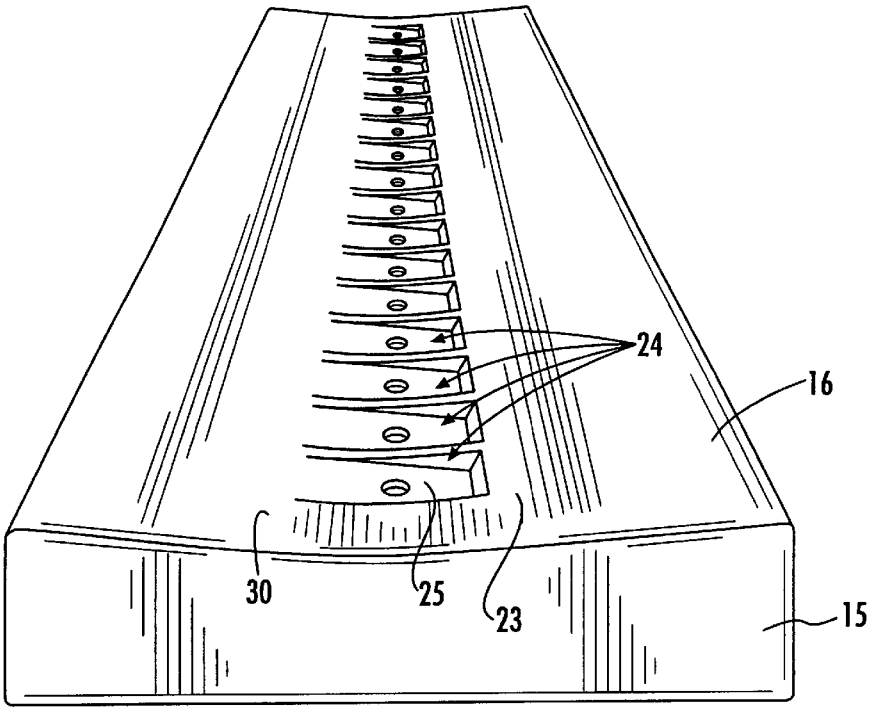
FIG. 2 is a perspective view of a first embodiment of an extended nip press shoe according to the present invention.
Figure 4:
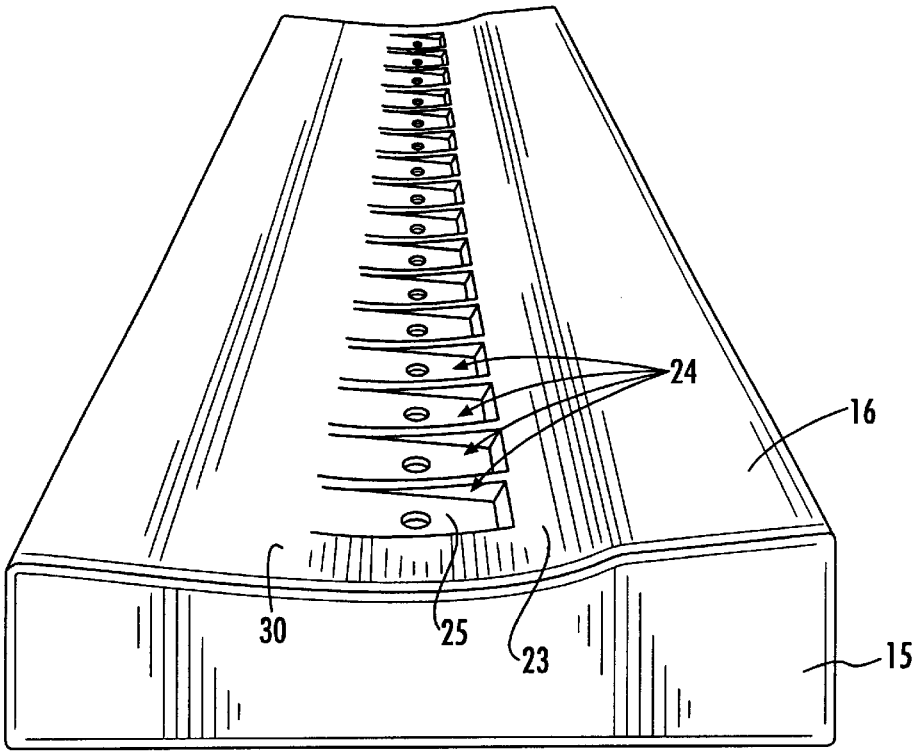
FIG. 4 is a perspective view of a second embodiment of an extended nip press shoe according to the present invention.

Immediately downstream of the inrunning land surface 23 is a lubrication pocket 24. The lubrication pocket 24 defines a cavity for holding a reservoir of lubricant which creates a hydrostatic lubrication region with the flexible jacket 11. The pocket 24 has a bottom surface 25 which converges towards the flexible jacket 11 in a downstream direction. Accordingly, the depth of the pocket 24 decreases in depth in the machine direction. This provides a smooth transition from the hydrostatic lubrication region of the pocket 24. As illustrated in FIGS. 2 and 4, several lubrication pockets 24 may be arranged side-by-side and extend in the cross machine direction.

A lubricant supply channel 26 directs lubricant from a lubricant supply source 27 into the pocket 24. In the embodiments shown in the drawings, the lubricant supply channel 26 opens into the bottom surface 25 of the shoe 15 but it could also open into the step between the inrunning land surface 23 and the bottom surface 25.

Figure 3:
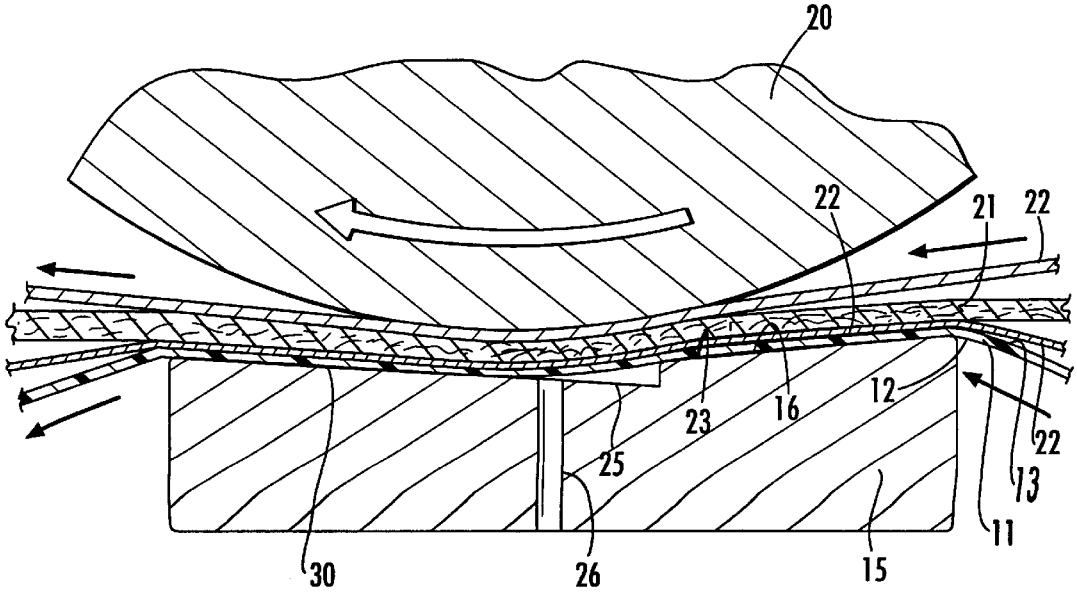
FIG. 3 is an enlarged sectional view of the press shoe of FIG. 2.
Figure 5:
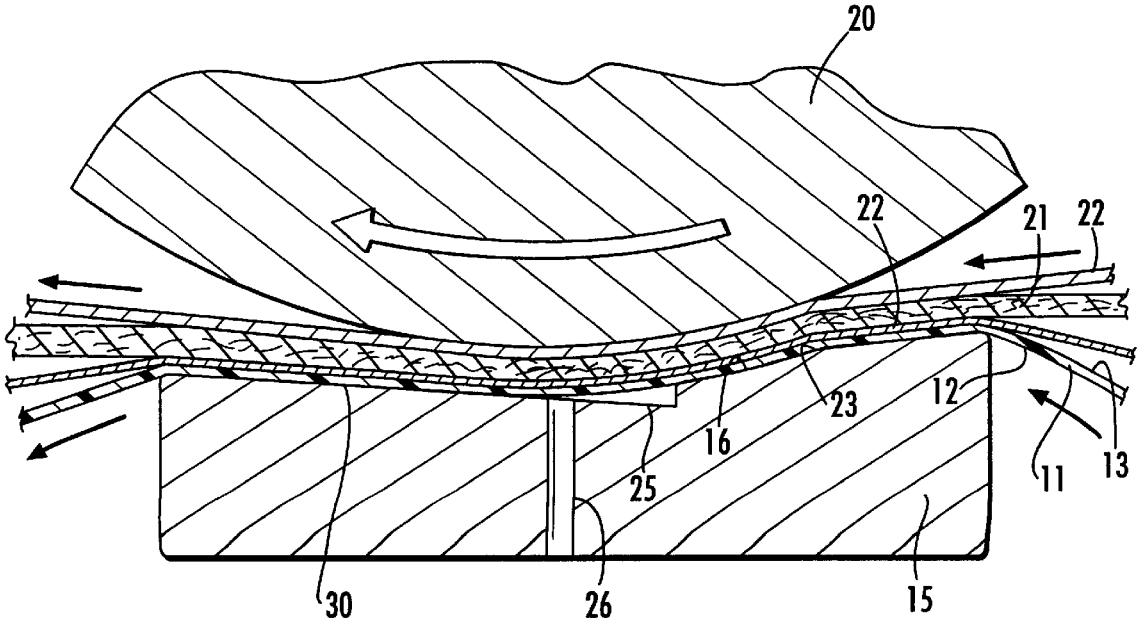
FIG. 5 is an enlarged sectional view of the press shoe of FIG. 4.

An outrunning land surface 30 extends downstream from the lubrication pocket 24 and engages the flexible jacket 11 against the opposite convex press element 20 at a downstream end of the extended nip press 10. Advantageously, the outrunning land surface 30 has a radius of curvature which is greater than the radius of curvature of the convex press element 20. In particular, the outrunning land surface 30 is planar as illustrated in FIGS. 3 and 5. The planar bottom surface 25 of the pocket 24 may be coplanar with the outrunning land surface 30 or slightly canted relative to the outrunning land surface by 1 to 5 degrees so as to define an included angle facing the jacket 11 of 175 to 179 degrees.

Since the outrunning land surface 30 is not in an interfitting concave-convex relationship with the convex press element 20, there will be almost no area of hydrodynamic lubrication downstream of the pressure pocket 24. Because the outrunning land surface 30 has a radius of curvature greater than the counter press element 20, the outrunning land surface and counter press element would engage in only line contact if the fibrous web 21, felts 22 and jacket 11 were removed. In other words, the length of engagement in the machine direction of the present invention is much less than in prior designs where the outrunning land surface and counter press element have substantially the same radius of curvature (except for the minor differences attributable to the finite thicknesses of the web, felts and jacket), such as is illustrated in U.S. Pat. No. 5,262,011 to Ilmarinen.

Therefore, hydrodynamic lubrication (and heat generation) may occur in a small area immediately downstream of the lubrication pressure pocket (hydrostatic pocket) 24 because there is a small gap between the press shoe 15 and convex press element 20 just downstream of the convex press element. However, this area is small (because the convex press element 20 quickly curves away from the press shoe 15) and very little frictional heat is generated compared to a conventional extended nip press. It should be understood that the invention reduces frictional heat rather than eliminating it.

It should also be understood that the advantages of the invention can generally be realized when the outrunning land surface 30 is of any contour which does not form an interfitting concave-convex relationship with the convex press element 20 and an elongated downstream hydrodynamic region is avoided. For example, the outrunning land surface 30 may be concave but with a radius of curvature greater than the convex press element 20. The outrunning land surface 30 can also be nonconcave, such as the planar configuration shown, and even convex.

Due to the above explained features of the invention, the extended nip press 10 will have almost no area of hydrodynamic lubrication downstream of the hydrostatic pocket 24. As a consequence, very little frictional heat will be generated during operation of the extended nip press 10, even if the press is given a high linear loading and operated at high machine speeds. Accordingly, great improvements in productivity can be realized.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. An extended nip press for dewatering a fibrous web as the fibrous web passes through the press in a machine direction, said extended nip press comprising:

a convex press element having a convex press surface;

a flexible jacket having at least one surface impervious to water for pressing the fibrous web against said press element and thereby dewatering the fibrous web;

a support beam extending in a cross machine direction on the opposite side of said jacket from said convex press element;

at least one actuator supported by said support beam for creating a pressing force in the general direction of said convex press element; and a shoe mounted on said actuator for pressing said flexible jacket and the fibrous web against said convex press element, said shoe having a face comprising;

an inrunning land surface for engaging said flexible jacket against said convex press element at an upstream end of the extended nip press;

a single lubrication pocket or a single row of lubrication pockets extending in the cross machine direction downstream of said inrunning land surface, said lubrication pocket defining a cavity for supporting lubricant to create a hydrostatic lubrication region with said flexible jacket, said pocket having a bottom surface converging towards said flexible jacket in a downstream direction; and an outrunning land surface downstream of said lubrication pocket for engaging said flexible jacket against said convex press element at a downstream end of the extended nip press, said outrunning land surface having a radius of curvature greater than the radius of curvature of the convex press element to create an attenuated hydrodynamic lubrication region with said flexible jacket.

2. An extended nip press as defined in claim 1 wherein said outrunning land surface is planar.

3. An extended nip press as defined in claim 1 wherein said outrunning land surface is concave.

4. An extended nip press as defined in claim 1 wherein said outrunning land surface is convex.

5. An extended nip press as defined in claim 1 wherein said inrunning land surface is planar.

6. An extended nip press as defined in claim 1 wherein said inrunning land surface is concave.

7. An extended nip press as defined in claim 6 wherein said inrunning land surface has a radius of curvature corresponding to the radius of curvature of said convex press element.

8. An extended nip press as defined in claim 1 wherein said bottom surface of said lubrication pocket is planar.

9. An extended nip press as defined in claim 2 wherein said bottom surface of said lubrication pocket is planar and coplanar with said outrunning land surface.

10. An extended nip press as defined in claim 1 wherein said flexible jacket is tubular and extends around said support beam.

11. An extended nip press as defined in claim 1 wherein said convex press element comprises a cylindrical roll.

12. An extended nip press as defined in claim 1 further comprising at least one felt adjacent a side of the fibrous web for absorbing water pressed from the web.

13. An extended nip press shoe for engaging a flexible jacket moving in a machine direction against an opposite convex press element having a predetermined radius of curvature, said shoe having a face comprising:

an inrunning land surface for engaging the flexible jacket against the opposite convex press element at an upstream end of the extended nip press;

a single lubrication pocket or a single row of lubrication pockets extending in the cross machine direction downstream of said inrunning land surface, said lubrication pocket defining a cavity for supporting lubricant to create a hydrostatic lubrication region with the flexible jacket, said pocket having a bottom surface converging towards the flexible jacket in a downstream direction; and an outrunning land surface downstream of said lubrication pocket for engaging the flexible jacket against the opposite convex press element at a downstream end of the extended nip press, said outrunning land surface having a radius of curvature greater than the radius of curvature of the convex press element to create an attenuated hydrodynamic lubrication region with the flexible jacket.

14. An extended nip press shoe as defined in claim 13 wherein said outrunning land surface is planar.

15. An extended nip press shoe as defined in claim 13 wherein said outrunning land surface is concave.

16. An extended nip press shoe as defined in claim 13 wherein said outrunning land surface is convex.

17. An extended nip press shoe as defined in claim 13 wherein said inrunning land surface is planar.

18. An extended nip press shoe as defined in claim 13 wherein said inrunning land surface is concave.

19. An extended nip press shoe as defined in claim 18 wherein said inrunning land surface has a radius of curvature corresponding to the radius of curvature of the convex press element.

20. An extended nip press shoe as defined in claim 13 wherein said bottom surface of said lubrication pocket is planar.

21. An extended nip press shoe as defined in claim 14 wherein said bottom surface of said lubrication pocket is planar and coplanar with said outrunning land surface.

22. An extended nip press shoe as defined in claim 14 wherein said bottom surface of said lubrication pocket defines a plane which is offset from the plane defined by said outrunning land surface by about 1 to 5 degrees.

23. An extended nip press shoe for engaging a flexible jacket moving in a machine direction against an opposite convex press element, said shoe having a face comprising:

an inrunning land surface for engaging the flexible jacket against the opposite convex press element at an upstream end of the extended nip press;

a single lubrication pocket or a single row of lubrication pockets extending in the cross machine direction downstream of said inrunning land surface, said lubrication pocket defining a cavity for supporting lubricant to create a hydrostatic lubrication region with the flexible jacket, said pocket having a bottom surface converging towards the flexible jacket in a downstream direction; and an outrunning land surface downstream of said lubrication pocket for engaging the flexible jacket against the opposite convex press element at a downstream end of the extended nip press, said outrunning land surface having a nonconcave contour to create an attenuated hydrodynamic lubrication region with the flexible jacket.

24. An extended nip press shoe as defined in claim 13 wherein said outrunning land surface is planar.

25. An extended nip press shoe as defined in claim 23 wherein said outrunning land surface is convex.

26. An extended nip press shoe as defined in claim 23 wherein said inrunning land surface is planar.

27. An extended nip press shoe as defined in claim 23 wherein said inrunning land surface is concave.

28. An extended nip press shoe as defined in claim 27 wherein said inrunning land surface has a radius of curvature corresponding to the radius of curvature of the convex press element.

29. An extended nip press shoe as defined in claim 23 wherein said bottom surface of said lubrication pocket is planar.

30. An extended nip press shoe as defined in claim 24 where said bottom surface of said lubrication pocket is planar and coplanar with said outrunning land surface.

31. An extended nip press shoe as defined in claim 24 wherein said bottom surface of said lubrication pocket defines a plane which is offset from the plane defined by said outrunning land surface by about 1 to 5 degrees.

* * * * *

UNITED STATES PATENT AND TRADEMARK OFFICE

CERTIFICATE OF CORRECTION

PATENT NO. : 5,997,695

DATED : December 7, 1999

INVENTOR(S) : Ilmarinen

It is certified that error appears in the above-identified patent and that said Letters Patent is hereby corrected as shown below:

Column 8, line 45, "claim 13" should read --claim 23--.

Signed and Sealed this

Twenty-second Day of August, 2000

*Attest:*

Q. TODD DICKINSON

*Attesting Officer*

*Director of Patents and Trademarks*